United States Patent [19]

Tóth

[11] Patent Number: 4,526,319

[45] Date of Patent: Jul. 2, 1985

[54] LOCAL HEATING INSTALLATION

[76] Inventor: László Tóth, IX. Bakáts tér 3, Budapest, Hungary

[21] Appl. No.: 440,291

[22] Filed: Nov. 9, 1982

[30] Foreign Application Priority Data

Nov. 16, 1981 [HU] Hungary ..... 3419

[51] Int. Cl.[3] ..... F24D 5/00

[52] U.S. Cl. ..... 237/50; 126/99 C; 126/99 R

[58] Field of Search ..... 237/50, 55, 51; 126/99 A, 87, 66, 67, 99 C, 99 R

[56] References Cited

U.S. PATENT DOCUMENTS

| | | | |
|---|---|---|---|
| 1,600,725 | 9/1926 | Flaus | 237/55 X |
| 2,272,428 | 2/1942 | Pedersen | 237/55 |
| 3,053,455 | 9/1962 | Eichenlaub | 237/51 |

FOREIGN PATENT DOCUMENTS

| | | | |
|---|---|---|---|
| 1124379 | 5/1955 | France | 237/55 |

*Primary Examiner*—Henry Bennett
*Attorney, Agent, or Firm*—Handal & Morofsky

[57] ABSTRACT

A heating installation for local use is disclosed which is to be operated by aggregate fuel having both direct and indirect thermal emission, with a reactor receiving the combustion chamber, and a waste-heat flue above the reactor as well as an outer heat accumulator case, wherein a waste-heat flue is disposed in the space above the reactor and which flue is essentially developed by having a helical elevation between an outer heat accumulator case and an inner heat accumulator case, while air channels are formed opening into the inner space of the air space to be heated between the reactor case which is made of metal encircling directly the reactor case and the outer heat accumulator case which is connected with at least one, adherent part of the combustion chamber, while it is also connected with the air space to be heated, wherein both the outer and inner heat accumulator cases are of hollow walls, and are fitted together from ring-shaped ceramic modular elements, wherein the modular elements have section-shaped distance rings arranged fitted together in pairs and filled with sand and provided with interruptions for the continuous elevation of the waste-heat flue without change of direction.

3 Claims, 3 Drawing Figures

LOCAL HEATING INSTALLATION

SUMMARY OF INVENTION

As it is well-known the heating installation operated in a local, that is to say in an area to be heated, may be classified first of all, according to their method of operation, or their fuel.

On the basis of the method of operation the following are distinguished:

a. thermal energy produced by the combusted fuel, heating installations (iron stoves, sheet cooking ranges, oil stoves, heat-radiators etc).

b. heating installations (cockle stoves, oil or water charged radiators, thermal fireplaces etc.) emitting with delay, directly thermal energy of the combusted fuel, storing in heat accumulator, and with distribution in time the stored thermal energy.

The advantage of the heating installations belonging to the first group is that following the beginning of the firing, practically at the same time, the thermal supply begins. However, their disadvantage is that, due to their very small thermal inertia, in case of exhausting or elimination of the power supply the thermal supply comes to an end at the same time or with small delay. Their further disadvantage is that when moving away from the radiating body sensation of warmth diminishes proportionally with the distance, depending on the density of energy.

The advantage of the heating installation storing the thermal energy in an intermediate reservoir, belonging to the second group in contradiction with the first group is that as a result of their great thermal inertia the produced thermal energy is given down uniformly, irrespective of the operation of the source of heat. On the other hand the disadvantage of these second installations is that owing to their great thermal inertia commencement of the thermal supply and heating of the air space to be heated take a long time, following the starting up of the source of heat.

The local heating installations according to the used fuel may be classified as follows:

solid fuel (coal, wood, mixed)
liquid fuel (Diesel fuel, etc.)
aeriform fuel (town-gas, natural gas etc.)
electric (directly radiating, microwave etc.)

To fire the different fuels at an adequate efficiency or to make use of these for firing purposes heating installations developed independently of the method of operation are required.

For that very reason the most common disadvantageous characteristic of the heating installations is that modification or change of the fuels may be achieved only by means of loss of efficiency or there is no possibility for this at all, (for example neither the iron stove can be transformed to oil heating, or the the installations of oil heating can be transformed to mixed heating-irrespective of their structural formation).

The aim of this invention is to establish such a local heating installation which combines/unifies the advantages of the direct and indirect thermal radiating, eliminating by this their disadvantages, and at the same time permitting utilization of other fuels, according to choice, or quick conversion to other fuel without losing the efficiency, if needed.

In accordance with the invention the problem is solved by a local heating installation without fracture of air direction having a flue of which is uniform above the reactor receiving the combustion chamber. The flue is developed essentially by a helical elevation, between the outer heater accumulator case of the heating installation and an inner heater accumulator case, while air channels are formed opening to the inner space of the air space to be heated, between the reactor case encircling directly the reactor and the outer heat accumulator case, which are connected with at least one, adherent part to close in the height of the bottom of the combustion chamber, also connected with the air space to be heated.

The heating installation according to the invention united advantages of the different possible methods of operation, after having realized the direct heat emission, through the outer heat accumulator case, while the air channels discharging into the inner space of the inner heat accumulator permit the direct and immediate taking out of the quantity of heat to be heated in the air space in the reactor.

On the one hand formation of a uniform helical runway enables the maximum utilization of the "waste" thermal energy of the flue gas leaving into the chimney for heating of the stove body,—on the other hand it ensures the "chimney effect", i.e. the draft for the distortion of the flue gas resulting from the temperature difference of the flue gas. Otherwise, besides the formation of the suitable reactor space this condition makes it possible that the heating installation according to the invention could be operated by any kind of fuel.

In compliance with the practical execution of the invention the outer and inner heater accumulator case is set up from ceramic module elements of hollow wall, the hollows of which are filled up with sand or other similar filling material.

This solution has the extraordinary great advantage that simplifies considerably and makes more efficient the production, it makes available quick and total assembly, while making the device portable, since certain elements of this installation may be transported easily by main force. By filling out the hollows of the module elements the weight of the heating installation, its stability, floor load and thermal inertia (thermal capacity) may be regulated between given limits.

Ceramics module elements constituting the outer heat accumulator case of the stove body may be provided by surface treatment (for example by glazing) and may be ready combusted with one process.

Further details and pecularities of the invention are shown on the enclosed drawing, indicating execution form of the heating installation according to the invention.

Figure 1:
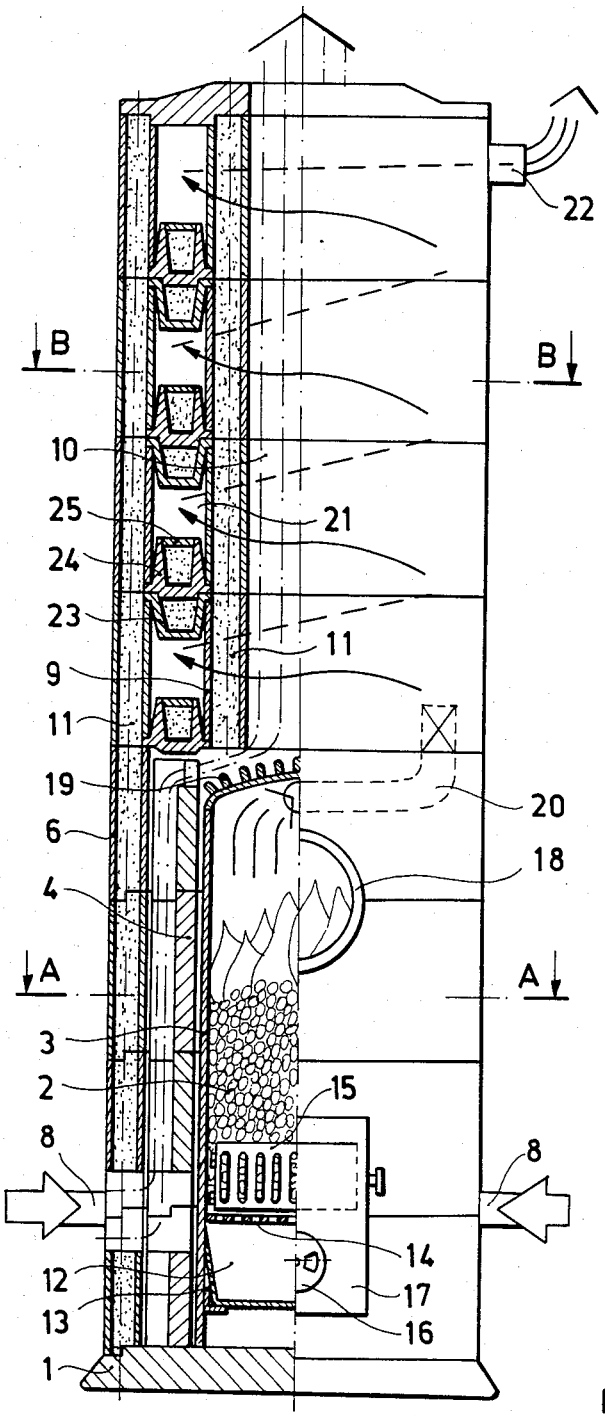
FIG. 1 shows a heating installation in half-view half-section.
Figure 2:
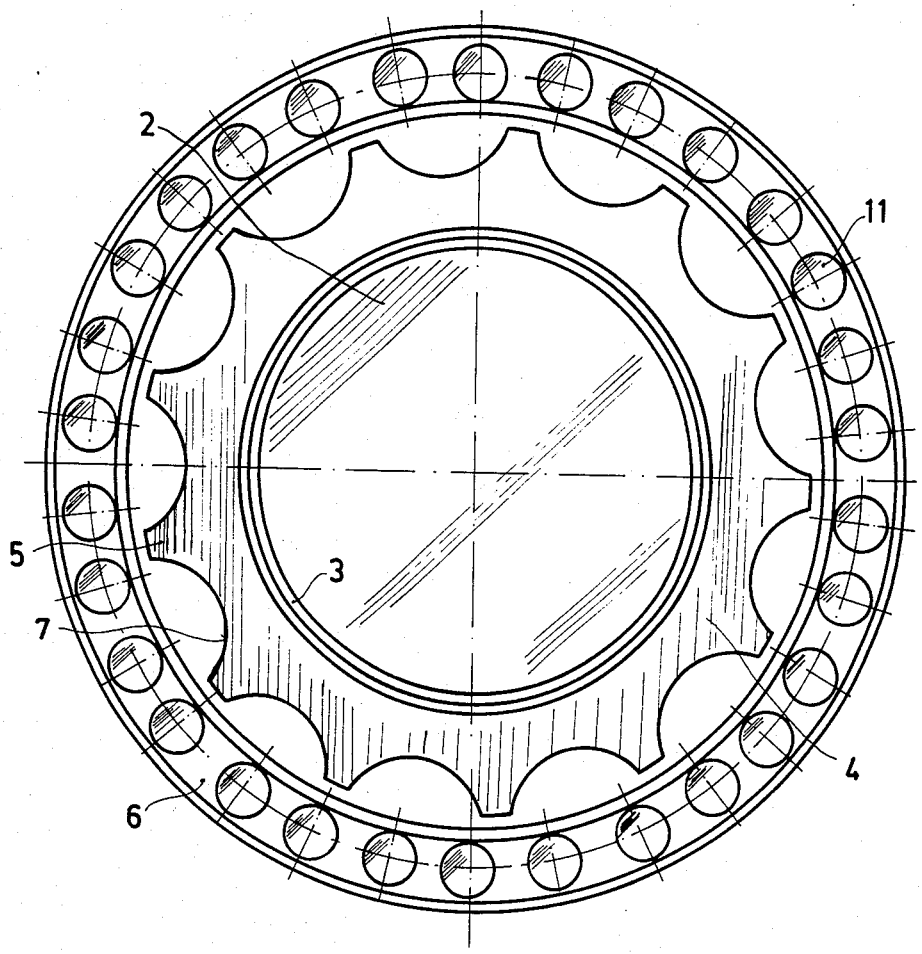
FIG. 2 is a section according to A—A line of FIG. 1, through the reactor part of the heating installation.

As it can be seen on FIG. 1 the heating installation according to the invention consists of two main parts, to be more precise a reactor part and a recuperator part developed above this. Mass of the stove body constituted by these is taken up and distributed by load 1 distributing support. Core of the reactor part is constructed by reactor 3, receiving combustion space 2 made of cast iron or steel plate which consists essentially of an iron stove. The reactor 3 is encircled by reactor case 4, which consists of ribbed ceramic module elements. The reactor case 4 as it can be seen on FIG. 2 is supported by its axial ribs 5 bordering from outside the heating installation, and it is also supported by the inner wall of the outer heat accumulator case 6 consisting of ring-shaped, but unribbed ceramic module elements, and together with this inner wall they form air channels discharging into inner space 10 of the inner heat accumulator case 9 arranged in the recuperator part above reactor 3. Adherent part 8 including catch close means extend from the combustion space 2 of the interfin-spaces 7. The inner heat accumulator case 9 is the same size as that of the outer heat accumulator case 6, but it is composed of ring-shaped ceramic module elements of smaller diameter and the inner space 10 open directly to the space to be heated. Both the outer heater accumulator case 6 and the inner accumulator case 9 in axial longitudinal direction include 11 hollows formed to be filled up by sand suitably, in the wall of the ceramic module elements.

In the heating installation to be seen on FIG. 1, the height of the reactor part corresponds to the ring-shaped ceramic modul elements of the outer heat accumulator case 6 placed to one another. The first two module elements include ash dumps 12 of reactors 3 and ash bin set 13 in ash dump 12 (or in case of oil firing the fuel oil tank, and in case of gas firing the gas regulating and joining fittings) boiler grate 14 above this and ember pliers 15, which are covered by ash dump door 17 provided with regulating closing element 16 of gap cross-section, and the above mentioned adherent part 8 fitted with catches to close the opening into the air space to be heated at the height of boiler grate 14. It is to be mentioned that load 1 distributing support in a given case may form one piece together with the lowest module element of the outer 6 heat accumulator case.

Figure 3:
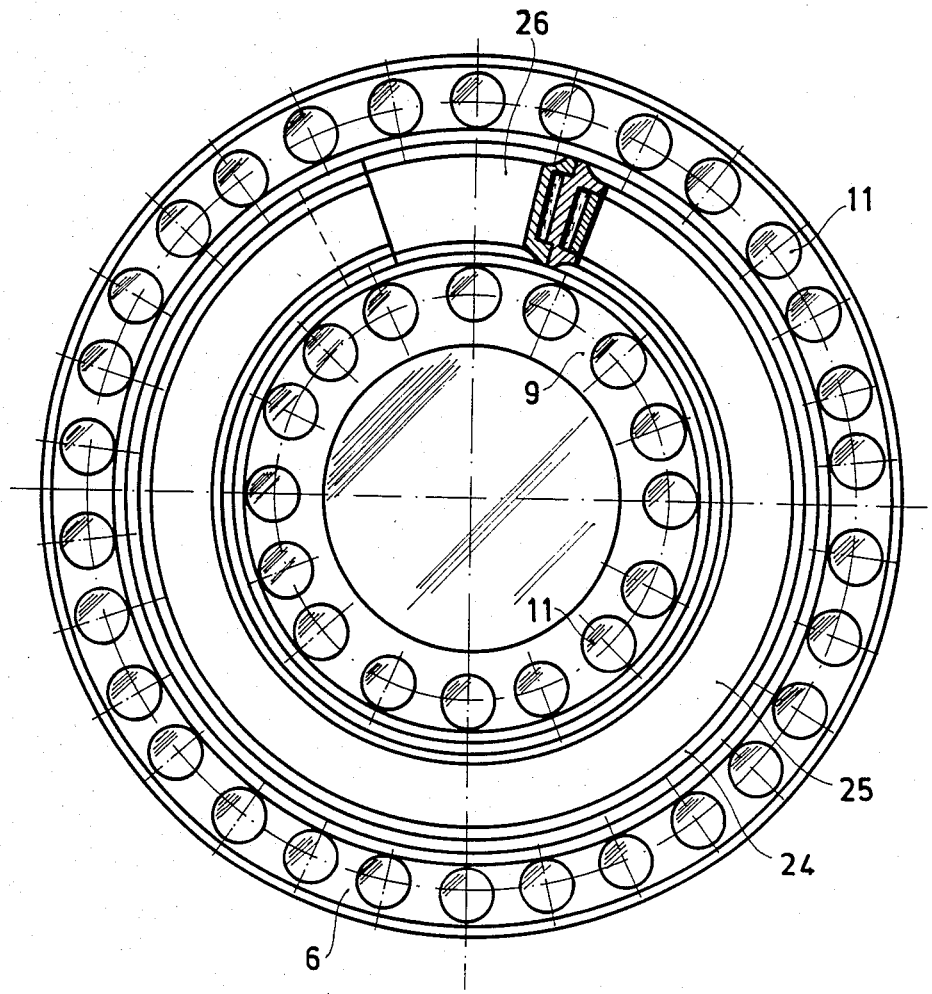
FIG. 3 is a section according to the B—B line of FIG. 1, through the recuperator part of the heating installation.

Above ash dump door 17 doors 18 are formed to charge solid fuel into reactor 3 falling on the third and fourth dead line of the modul element, where a suitably fireproof transparent glass insert is installed permitting observation of combustion chamber 2. The upper part of the reactor is encircled by the fourth module element, closes from above with ribbed cap 19 promoting the heat exchange, and from this place departs the waste-heat flue 20 adherent part, too, which connect combustion chamber 2 of reactor in the recuperator part with waste-heat flue 21 shaped between heat accumulator cases 6 and 9, which essentially terminates in fumeduct 22, forming a helical runway. The position of heat accumulator 6 and 9 and fitting their module elements to one another are strengthened by distance rings 23 and 24 fitting into one another in pairs, made of ceramics, whereas distance rings 23 are closed by distance rings 24 inserted into it, while distance rings 24 are closed by cover rings 25. This arrangement can be seen especially well on FIG. 3 compared with FIG. 1. These distance elements are provided with such interruptions 26 which guarantee continuous elevation without change of direction of waste-heat flue 21, as well as the getting through of waste-heat flue to the following level of the modul elements.

It is advantageous to install a heat distributing screen above the stove body not indicated on the drawing, more precisely, above the inner chamber 10 opening into the inner heat accumulator case 9 to be heated, in the way of the hot air flowing upwards with relatively great speed, which on the one hand protects the ceiling, and on the other hand spreads the outflowing hot air in the air chamber to be heated. Also it is not indicated on the drawing the air delivery device which is built-in the inner chamber 10 suitably and in addition to the kinectic energy given from the temperature difference it promotes the air circulation by its operation if needed, which in case of floor heating may be of opposite (downwards) direction. In this latter case naturally it is definitely a necessary operation of the air delivery device. At last it is also suitable to set in the fumeduct 22 extensions draft sensing automatics which always controls the depression in the furnace chamber in compliance with the requirements of the given method of heating, and contributing by this to the fact that the heating installation according to the invention be operated by any kind of aggregate at discretion.

Method of operation of the heating installation according to the invention in case of utilizing solid fuel is as follows:

The solid fuel is charged through door 18 fitted with a circular transparent, fireproof glass insert to the boiler grate 14 of reactor 3, where the combustion air passing through boiler grate 14 enables regulated combustion of fuel being in combustion space 2. Otherwise the combustion air gets to the ash dump 12 through ash dump door 17, formed to this effect, where it gets to boiler grate 14 coming round ash bin 13.

The flue gas rises in combustion space of reactor 3 get to the recuperator part through waste-heat flue adherent part 20, formed particularly on the top of reactor 3, where on the levels shaped by certain module elements after performing some 300° turn as a special deflecting mouth, through rupture 26 formed on a section some 60° get to the following level without rupture of direction, at last through fumeduct 22 to the chimney. In the waste-heat flue 21 the flue gas passes on the heat content to the outer and inner heat accumulator cases 6 and 9 which transmit the assumed heat to the air space to be heated by constant delayed heat emission, as it is characteristic of the operation of the cockle stoves.

At the same time, however, it is possible to make heat immediately by the heating installation according to the invention, following the kindle of the air space to be heated. For this purpose the outer heat accumulator case 6 between the reactors case 4 encircling directly the reactor 3, and through the adherent parts 8 built-in at the height of the bottom of the combustion space 2 the air of the air space to be heated is introduced, and flows through in the air channels formed by the reactor case 4 and interfin-spaces 7, which discharge into the inner spaces 10 of the inner heat accumulator case 9 above the ribbed cap 19, operating as heat exchanger of the reactor 3 of the air channels. Passing by the reactor cases 4 of the surrounding reactor 3 the air flowing through the adherent parts 8 partly takes on the emitted heat quantity, partly cools the reactor case 4 connecting directly wall of the reactor 3. The air heated in this way flows up until the heat distributing screen with a so-called "chimney effect" in the inner space 10, by means of its kinetic energy arising from the difference of heat, flowing through the upper part of reactor 3, where with an interruption of direction moves into the air space to be heated.

If the air space to be heated achieved the proper temperature, catches of the adherent part 8 would be closed either by hand or by thermostat control, thus the heating installation operates from this time on only by direct heat emission.

Besides the described structural arrangement the heat installation according to the invention may also be operated by any kind of fuel at discretion on a suitable efficiency, while its method of operation that is to say the direct and indirect emission may be also freely choose besides the simultaneous recuperation of the thermal energy of the flue gas. Change of the method of operation may be effected without changing the elements, simply by closing the adherent part 8. Further substantial advantage means that the installation may be fitted together from module elements, thus it may be easily removed to another place by hand, and last but not least its assembly does not require any special knowledge. It is to be noted that formation of the different components from module elements is not obligatory from the point of view of the essential operation of the equipment, however, it is very advantageous. Filling the hollows of the module elements with sand or other similar filling material of the inner and outer heat accumulator cases 6 and 9 has the great advantage that in the light of the filled quantity of sand enables to control suitably weight and thermal capacity of the heating installation (for example: floor load) in compliance with the prevailing requirements and possibilities when assembling the heating installation. The outer surface of the ceramic module elements of the outer heat accumulator case 6 may be surface treated both in respect of wear and tear, both in colouring, and it is coated with ornamental glaze of suitably aesthetic colouring. The outer outline of the outer heat accumulator case 6 is practically circular but other form, for example angular form may also be fancied. Size and number of the module elements may also change which is determined by the appropriateness and the thermal requirement.

I claim:

1. Heating installation for local use to be operated by aggregate fuel having both direct and indirect thermal emissions, a reactor within the combustion chamber, and a waste-heat flue and an outer heat accumulator case, said waste heat flue is defined by a uniform helical runway between said outer heat accumulator case and an inner heat accumulator case located above the reactor, air channels opening to a space to be heated being defined between a reactor case made of metal directly encircling the reactor and the outer heat accumulator case, said outer heat accumulator case being connected with at least one adherent part of the combustion chamber, wherein both the outer and inner heat accumulator cases are made with hollow walls and are fitted together from ring-shaped ceramic modular elements, said ceramic modular elements comprising "U" shaped distance rings fitted together in pairs and capable of being filled with sand and having interruptions for providing a continuous elevation of the waste heat flue, said waste heat flue transmitting heat to the outer heat accumulator case which in turn transmits heat by radiation to the space to be heated.

2. Heating installation for local use to be operated by aggregate fuel having both direct and indirect thermal emissions, a reactor within the combustion chamber, and a waste-heat flue and an outer heat accumulator case, said waste heat flue is defined by a uniform helical runway between said outer heat accumulator case and an inner heat accumulator case located above the reactor, air channels opening to a space to be heated being defined between a reactor case made of metal directly encircling the reactor and the outer heat accumulator case, said outer heat accumulator case being connected with at least one adherent part of the combustion chamber wherein said reactor case is shaped as a ceramic ribbed case having longitudinal ribs extending close to the inner side of said outer heat accumulator case, said longitudinal ribs forming interfin-spaces, wherein said interfin-spaces define the air channels leading into the inner space of said inner heat accumulator case.

3. The heating installation of claim 1, wherein the reactor case is assembled from the modular elements of equal height as the modular elements of the outer heat accumulator case.

* * * * *